US005242281A

United States Patent [19]

Hartley et al.

[11] Patent Number: 5,242,281

[45] Date of Patent: Sep. 7, 1993

[54] WOBBLE PLATE PUMP

[76] Inventors: E. Dale Hartley, 4100 Decker Rd., Malibu, Calif. 90265; F. Scott Hartley, 60 Mansfield La., Camarillo, Calif. 93010

[21] Appl. No.: 900,138

[22] Filed: Jun. 17, 1992

Related U.S. Application Data

[63] Continuation-in-part of Ser. No. 499,765, Mar. 27, 1990, Pat. No. 5,125,809.

[51] Int. Cl.[5] ..... F01C 1/02; F04C 2/02

[52] U.S. Cl. ..... 418/53

[58] Field of Search ..... 418/49, 50, 51, 52, 418/53

[56] References Cited

U.S. PATENT DOCUMENTS 801,917 10/1905 Samain ..... 418/51

3,816,037 6/1974 Germain ..... 418/53

FOREIGN PATENT DOCUMENTS 874838 8/1961 United Kingdom ..... 418/51

*Primary Examiner*—Richard E. Gluck

*Attorney, Agent, or Firm*—Gordon L. Peterson

[57] ABSTRACT

A pump assembly comprising a housing having a cavity therein, an inlet leading to the cavity and an outlet leading from the cavity and a wobble plate mounted for nutating movement in the cavity. The wobble plate divides the cavity into first and second pumping chambers, and during its nutating movement, liquid entering the inlet into the pumping chambers is pumped by the wobble plate through the outlet. The pump can be driven by a motor. The cavity has opposing wall sections and a resilient member is provided for resiliently urging the wobble plate toward the opposing wall section to improve the priming capability of the pump. Other features improve the priming capability of the pump along the periphery of the wobble plate.

21 Claims, 9 Drawing Sheets

FIG. 4
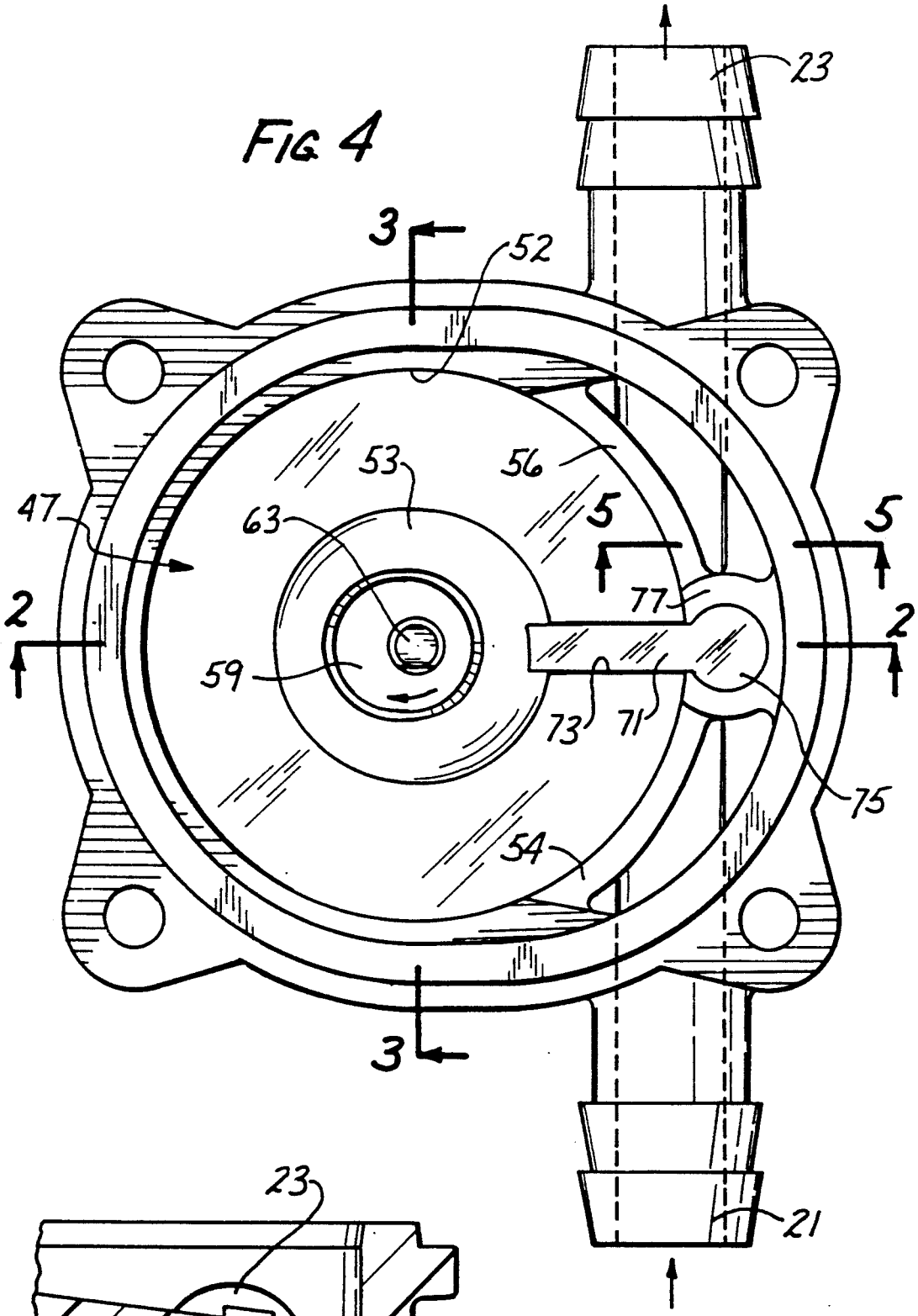
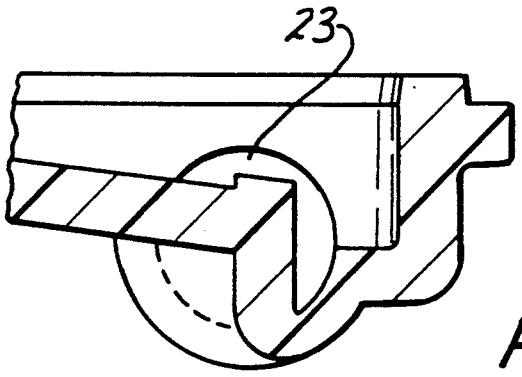
FIG. 5

Fig. 7
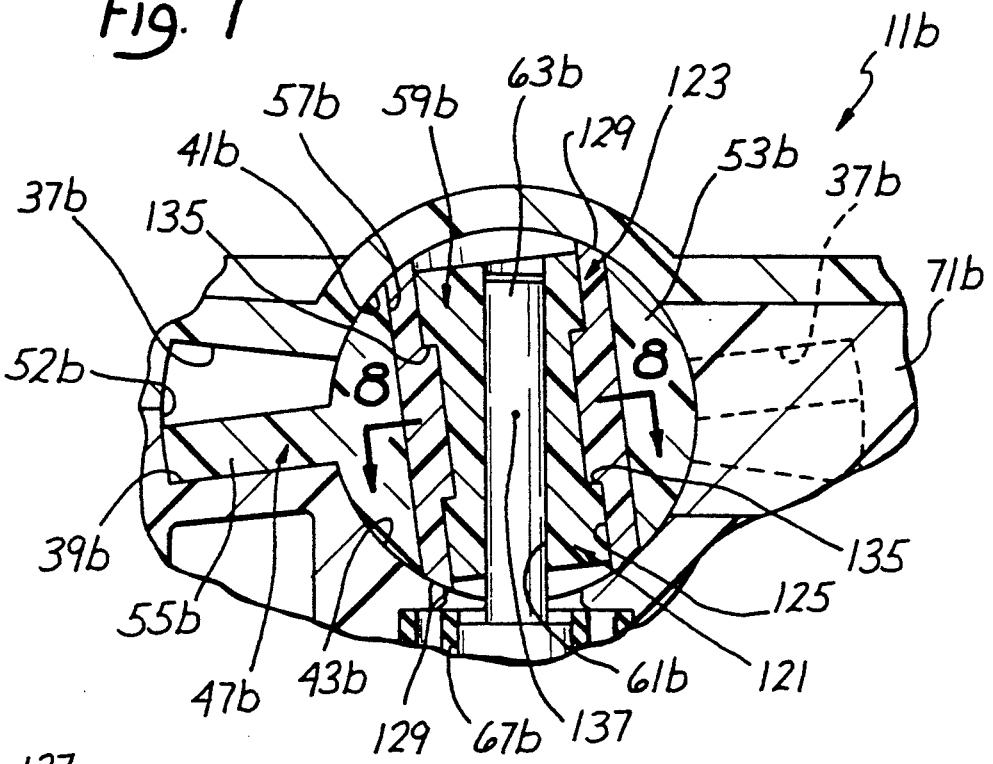
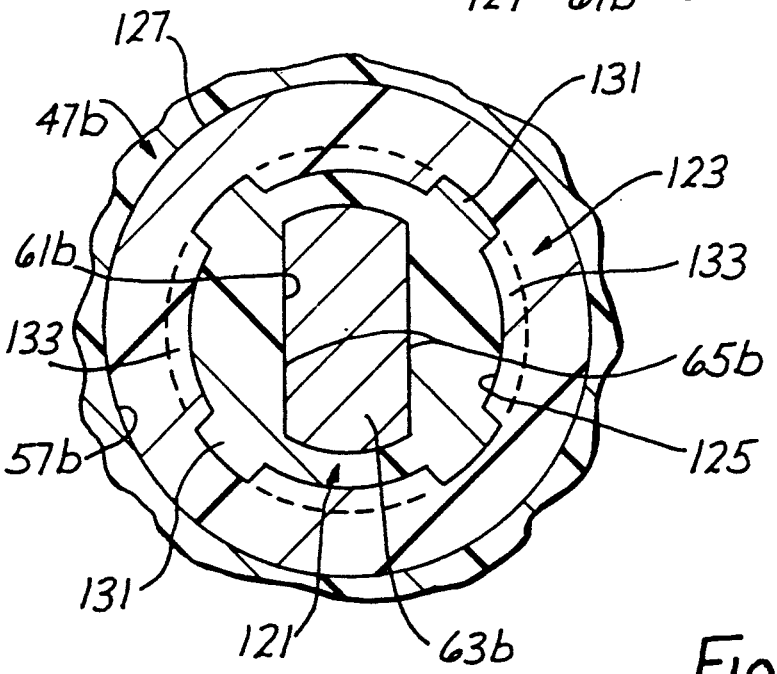
Fig. 8

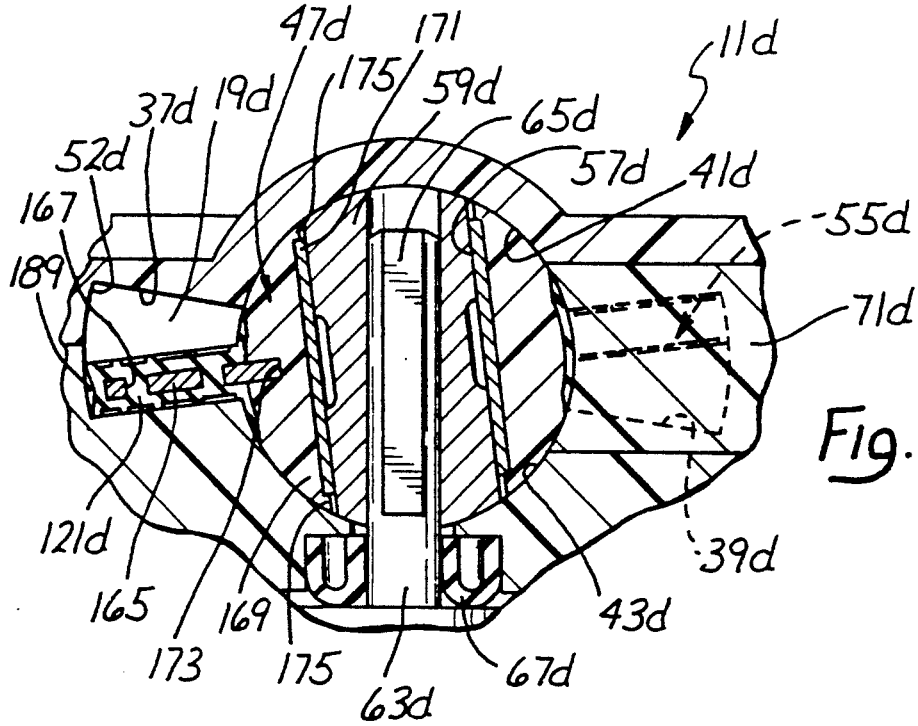
Fig. 11
Fig. 12
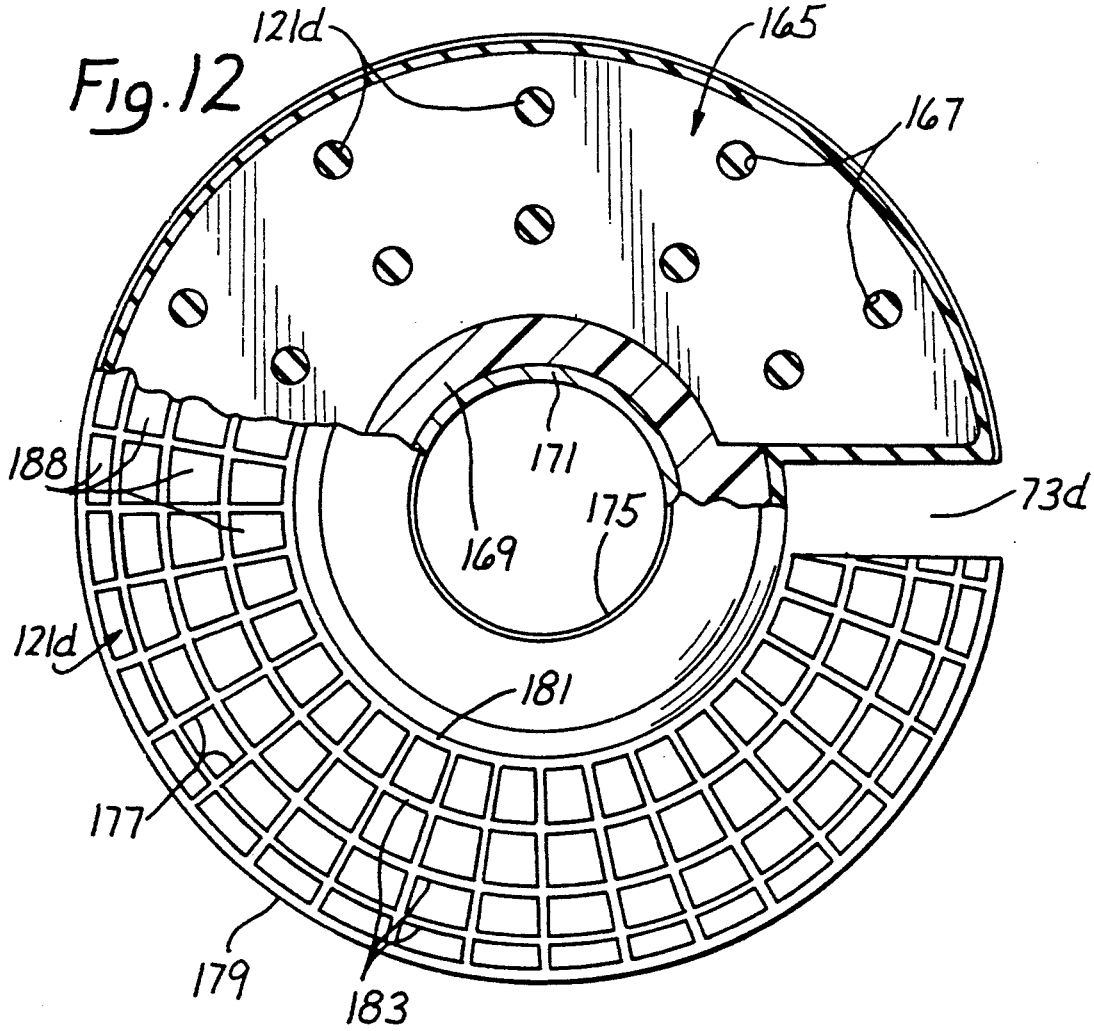

WOBBLE PLATE PUMP

CROSS REFERENCE TO RELATED APPLICATION

The application is a continuation-in-part of application Ser. No. 499,765 filed Mar. 27, 1990, now U.S. Pat. No. 5,125,809, entitled WOBBLE PLATE PUMP.

BACKGROUND OF THE INVENTION

A positive displacement pump typically utilizes a piston or diaphragm to act as a pumping member to move a liquid. The piston or diaphragm is reciprocated, and this tends to provide a pulsed output. The pulses or output surges can be reduced by using multiple chambers each with its own reciprocating member. However, typically the output from a positive displacement pump is not as even and continuous as may be desired for certain applications.

The pumping member or members can be reciprocated in various different ways. For example, in Hartley U.S. Pat. No. 4,797,069 a wobble plate is used in the drive train to drive multiple pistons in order to provide a multiple chamber pump. Although this pump works extremely well, it inherently provides a somewhat pulsed output.

In another prior art construction, a curved or wavy plate is rotated in a pumping chamber, with the curves of the plate providing the pumping action. This does reduce output surges. However, a separator slides back and forth in a slot to separate the liquid at inlet pressure from the liquid at outlet pressure, and it is difficult to seal the gap through which the separator moves. This wavy plate does not nutate and is of a rather complex configuration.

It is also known to rotate an inclined, flat plate in a pumping chamber. Although this is a simpler construction than the wavy plate, the inclined plate does not nutate and is subject to sealing problems.

To eliminate or substantially reduce output surges and to avoid the sealing problem noted above, a wobble plate, i.e., a plate mounted for nutating motion, can be utilized in a pumping chamber as the pumping member. The nutating motion of the wobble plate provides the pump with an essentially constant, i.e. nonpulsating, output. Also, by using the wobble plate as the pumping member rather than in the drive train leading to a piston or diaphragm-type pumping member, substantial simplification is achieved. The wobble plate is of simple construction, need not be of a wavy configuration and is not subject to the sealing problem referred to above.

SUMMARY OF THE INVENTION

One feature of this invention is to improve the priming capable of a wobble plate pump, i.e. a pump in which a wobble plate serves as the positive displacement pumping member. This is accomplished through the use of an appropriate resilient member and through the incorporation of other novel features which can be used in combination with, or independently of, the resilient member.

A pump constructed in accordance with this invention may include a housing having a cavity therein, an inlet leading to the cavity, an outlet leading from the cavity and a wobble plate in the cavity which divides the cavity into first and second pumping chambers. The wobble plate is mounted for nutating movement in the cavity so that liquid entering the inlet into the pumping chamber is pumped by the wobble plate through the outlet. Motor means drives the wobble plate in such nutating movement to provide a pump assembly.

Water meters similar to this construction have been known for many years. However, these water meters have no motor means and are driven by the water which flows through them with the movement of an output shaft along a conical path reflecting the quantity of water which flows through the water meter. Although water meters of this type have been known for many years, so far as we are aware, these water meters have not been modified to serve as pumps.

The cavity in the housing of the pump has opposing wall sections which are configured to allow the nutating movement of the wobble plate. To improve the priming capability of the pump, it is desired to have the wobble plate tightly engage these opposing wall sections during its nutating movement. Close tolerances are not an adequate solution because of the increased cost of maintaining close tolerances, and more importantly because even with close tolerances, the priming capability of pump may be insufficient.

This invention provides a resilient member to obtain the desired cooperation between the wobble plate and the opposing wall sections. The resilient member resiliently urges the wobble plate toward the opposing wall sections and preferably loads the wobble plate against the opposing wall sections. With this construction, the wobble plate can engage the opposing wall sections during the nutating movement of the wobble plate to considerably improve the priming capability of the pump. Also, the resilient member can accommodate minor surface irregularities on the engaging surfaces of the wobble plate and the opposing wall sections such that the pump runs smoothly.

In a preferred construction, the wobble plate includes a central hub, which is preferably of part-spherical configuration, and a flange circumscribing the hub. The flange, which does the pumping, can be flat and planar.

The cavity in the housing must be appropriately configured to allow the wobble plate to undergo nutating movement. Preferably the opposing wall sections of the cavity are opposing conical sections or opposing conical wall sections. In addition, the cavity preferably has opposing part-spherical sections. The part-spherical hub of the wobble plate is received in the part-spherical sections, and the flange lies between the conical sections.

The opposing conical wall sections diverge radially outwardly at a cone angle to allow the nutating movement of the wobble plate. The wobble plate is mounted for nutating movement about a center of nutation and through a wobble angle. The cone angle and the wobble angle can be of various different magnitudes with respect to each other so long as the wobble plate is resiliently urged toward the wall sections in the desired manner. For example, the wobble angle and the cone angle may be of about the same magnitude, and in this event, the components are preferably sized so that the wobble plate is resiliently loaded against the opposing wall sections. Alternatively, the wobble angle may be larger than the cone angle, and this would not be possible but for the resilient member. The resilient member allows the cooperation between the conical wall sections and the wobble plate to resiliently reduce the wobble plate angle to about the cone angle thereby achieving proper engagement between the wobble plate and the conical wall sections.

Another feature of the invention that may be obtained utilizing the resilient member is in modulating the output of the pump assembly in response to back pressure. If this feature of the invention is employed, the pump assembly has an output which reduces in accordance with the back pressure encountered at the outlet of the pump assembly. This technique is especially useful for high back pressures which would tend to provide a heavy load on the motor which drives the pump.

The resilient member can be integrated into the pump in any desired way to accomplish these important functions. For example, the wobble plate may include the resilient member. In one preferred construction, the resilient member forms a portion of the wobble plate and resiliently engages one, and preferably both, of the opposing wall sections of the cavity so that the resilient member resiliently loads the wobble plate against the opposing wall sections. Alternatively, the mounting assembly, which mounts the wobble plate for nutating movement, may include the resilient member. Particular examples of ways to integrate the resilient member into the mounting assembly of the pump can best be considered by first identifying examples of structures or assemblies that can be used to mount the wobble plate for nutating movement.

Various structures can be employed to mount the wobble plate for nutating movement in the cavity. For example, in one construction or assembly, the hub has a central passage, and there is a bushing in the central passage. The bushing has a bore, and the axes of the bore and the central passage are inclined relative to each other so that a rotating input applied to the bushing along the axis of the bore imparts a nutating movement to the wobble plate. This rotary input may be provided, for example, by a motor means which includes a rotatable shaft received in the bore and drivingly coupled to the bushing so that rotation of the shaft imparts nutating movement to the wobble plate. This construction has the advantage of being very simple and can be lubricated by the liquid being pumped by the pump.

When the above described mounting assembly is employed to mount the wobble plate for nutating movement in the cavity, the bushing may include the resilient member. For example, the bushing may include an outer sleeve in the central passage of the hub with the outer sleeve having a sleeve passage. In this event, the resilient member may be received in the sleeve passage and have the bore referred to above therein. Alternatively, the bushing may include an inner sleeve received in the sleeve passage and having the bore therein. The outer sleeve is pivotable relative to the inner sleeve and the resilient member urges the outer sleeve to pivot relative to the inner sleeve to resiliently load the wobble plate against the opposing wall sections. In this event, the resilient member may be provided between the outer and inner sleeves. For example, the resilient member may be constructed of an elastomeric material or may comprise one or more metal springs. Metal springs have the advantage of being less subject to aging and of being more compatible with a variety of media to be pumped.

In another construction, the mounting assembly or mounting means for the wobble plate includes a shaft coupled to the hub of the wobble plate and extending out of the cavity and means outside of the cavity responsive to a rotary input to move the shaft through a conical arc to impart the nutating movement to the wobble plate. One advantage of this mounting assembly is that the portion of the wobble plate mounting assembly which is outside the pumping chambers can be lubricated without danger of getting lubricant in the liquid being pumped. In addition, a shaft seal can be eliminated.

If the shaft seal is not used, it is preferred to employ a flexible boot sealed to the shaft and to the housing. With this invention, the boot is preferably attached and sealed to the shaft substantially at a radial zone of the shaft which includes the center of nutation. This minimizes flexure of the flexible boot, and this not only increases the life of the flexible boot, but also requires less energy than if the boot were subjected to greater flexure.

The resilient member can also be utilized as part of the wobble plate mounting assembly in which the shaft is subjected to movement through a conical arc. This can be accomplished, for example, by utilizing a mounting assembly which also includes a bearing assembly which movably receives the shaft and is responsive to the rotary input to move the shaft through the conical arc. The mounting assembly also includes a resilient member which is employed to urge the bearing assembly in a direction to resiliently urge the wobble plate against the opposing wall sections. This has the effect of resiliently urging the wobble plate to assume a larger wobble angle such that there is no gap between the wobble plate and the opposing wall sections along the lines or regions of contact between these members. In this regard, the bearing assembly must have enough free motion or slop to allow this amount of angular take up, and for this purpose, a ball bearing is preferred. Thus, with this construction as well as the construction employing the bushing, the resilient member urges the wobble plate to pivot about the center of nutating movement to tend to increase the wobble angle and to resiliently urge the wobble plate against the opposing wall sections.

When the wobble plate includes the resilient member, which is engageable with at least one of the opposing wall sections as the wobble plate undergoes nutating movement, the resilient member preferably has a plurality of generally radially extending ribs engageable with such wall sections as the wobble plate nutates. The ribs are desirable to obtain a high unit loading on the resilient member so that the resilient member can locally deform as it is forced against the wall section of the pump cavity. The unit loading can be increased by having each rib be of progressively decreasing cross sectional area as such rib extends outwardly. Although the circumferential spacing between adjacent radially extending ribs can be varied as desired, preferably at least two of these ribs are always in engagement with the wall section of the cavity as the wobble plate undergoes nutating movement. This provides added insurance that a radially extending rib will always engage the wall section during the nutating movement.

Preferably it is the flange of the wobble plate which includes the resilient member. The resilient member preferably has at least one generally annular region engageable with the wall section as the wobble plate undergoes nutating movement. This reduces noise by assuring that a portion of the resilient member will always be in contact .with the wall section at all positions of the wobble plate during its nutating movement.

The annular region may include one or more annular ribs. Preferably the resilient member has an outer annular rib which cooperates with the confronting wall section to form a liquid seal against the liquid being pumped spilling over the outer edge of the wobble plate. The resilient member also preferably has an inner annular rib which performs the same function at that location.

The resilient member may define a peripheral surface of the wobble plate. The peripheral surface has an outwardly opening annular groove which circumscribes the wobble plate and a plurality of dams extend across the groove. The groove provides the peripheral surface of the wobble plate with an improved capability to resiliently cooperate with the peripheral wall of the pump cavity. The dams prevent circumferential flow of the liquid being pumped along the peripheral surface of the wobble plate.

In order to mount the resilient member, the wobble plate includes a carrier which is more rigid than the resilient member and the resilient member is mounted on the carrier. Although the carrier can be of various different constructions, it preferably includes an apertured plate and the resilient member is molded on to the apertured plate. The carrier may also include a hub member having an opening extending therethrough, a sleeve in the opening and defining the central passage for receiving the bushing. In this construction, the plate extends generally radially of the hub member.

In a preferred construction, the housing has an opening leading to the cavity, and the pump includes a separator dividing the opening into the inlet and the outlet. The separator is fixedly mounted on the pump housing, and so the sealing problems associated with a sliding separator are eliminated, and the pump construction is simplified. The mounting means for the wobble plate includes a slot in the wobble plate which receives the separator so that the separator holds the wobble plate against rotation.

Another way in which the present invention increases the priming capability of the pump relates to the cooperation between the peripheral wall of the cavity in the pump housing and the peripheral surface of the flange of the wobble plate. The peripheral wall has inlet and outlet sections which provide inlet openings and outlet openings, respectively which communicate with the inlet and the outlet. The peripheral surface of flange of the wobble plate confronts the peripheral wall of the cavity and defines therewith radially narrow inlet and outlet gaps at the inlet and outlet sections of the peripheral wall, respectively. These gaps tend to allow the liquid being pumped to escape near the inlet and outlet of pump and reduce the priming capability of the pump.

This invention lengthens the gaps to thereby increase the resistance to flow through the gaps and reduce these liquid losses. With this invention, the peripheral surface of the flange has a width t at the gap and at least one of the inlet and outlet sections of the peripheral wall has a dimension at the associated gap which is equal to or greater than one half t. The dimension of the peripheral wall at the gap is preferably not greater than t because this could not increase the length of the gap. Although this relationship or lengthening of the gap can occur at only one of the inlet section and the outlet section, preferably it exists at both the inlet section and the outlet section so that both the inlet and outlet will receive the benefit of this feature.

Depending upon various factors such as the length and width of the gaps, the angular velocity of the input to the wobble plate and the viscosity of the liquid being pumped, there is a possibility of trapping liquid at or near the separator on the outlet side of the separator and of starving the pumping chambers for liquid on the inlet side of the separator. Another feature of this invention is to provide for relieving of the fluid which otherwise might be trapped. In this regard, the separator is between the inlet and outlet sections and the wobble plate has a slot which receives the separator to hold the wobble plate against rotation. The wobble plate has a flow channel adjacent the separator for allowing this liquid to flow therethrough to deal with the liquid trapping or starving problems noted above. Preferably at least one flow channel is provided for each of the gaps with the flow channel and associated gap being on the same side of the separator. In a preferred construction, the wobble plate is spaced from the separator to define the flow channel. In a still more preferred construction, one region of the slot slidably engages the separator to guide the wobble plate and another region of the slot is spaced from the separator to define the flow channel.

The housing for the pump includes at least first and second housing sections having confronting faces. The confronting faces have a complementary annular groove and annular rib, with the rib being received in the groove to accurately align the housing sections, This is particularly important so that the pumping chambers are accurately configured to accommodate the nutating movement of the wobble plate. This alignment technique eliminates the need for dowels.

The invention, together with additional features and advantages thereof may best be understood by reference to the following description taken in connection with the accompanying illustrative drawing.

BRIEF DESCRIPTION OF THE DRAWINGS

FIG. 4 is an elevational view of the pump, with the housing section 25 removed.

FIG. 5 is an enlarged fragmentary sectional view taken generally along line 5—5 of FIG. 4.

FIG. 7 is a fragmentary sectional view similar to FIG. 2 showing one way to utilize the resilient member.

FIG. 8 is an enlarged sectional view taken generally along line 8—8 of FIG. 7.

FIG. 11 is a fragmentary sectional view similar to FIG. 2 showing another way to employ the resilient element.

FIG. 12 is an enlarged elevational view partially in section of the wobble plate employed with the embodiment of FIG. 11.

DESCRIPTION OF THE PREFERRED EMBODIMENT

Figure 2:
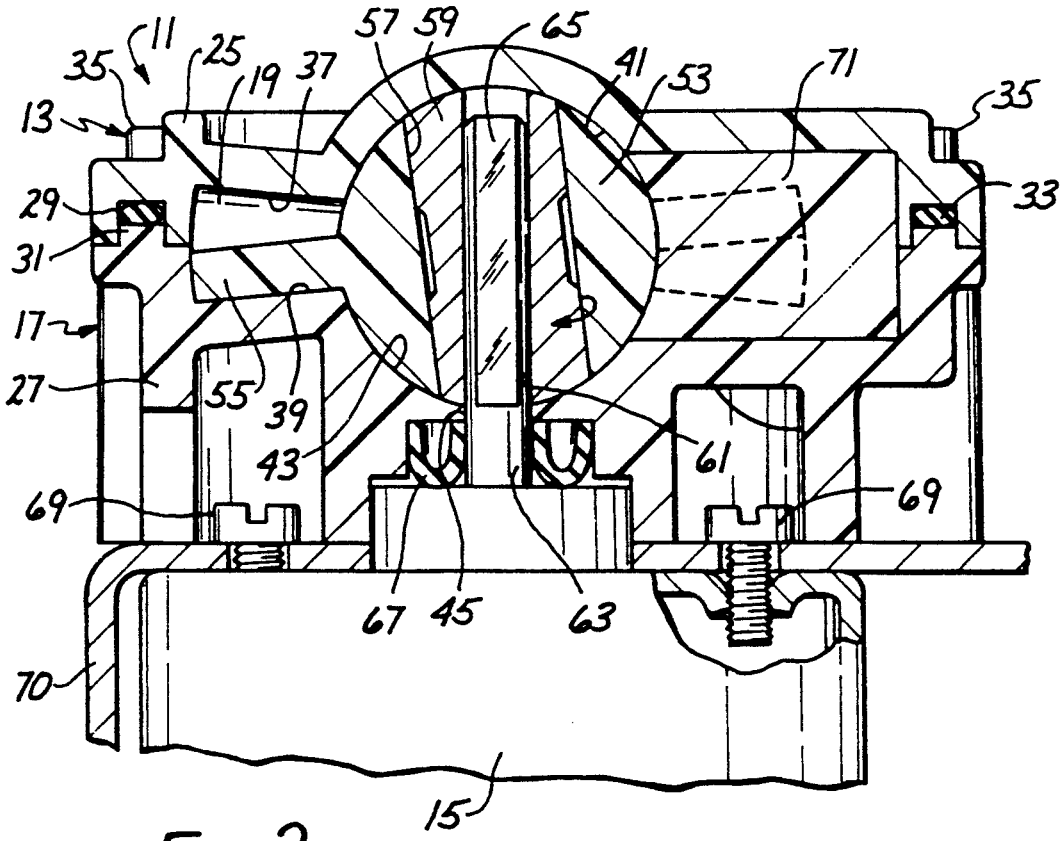
FIG. 2 is an axial sectional view through a pump assembly constructed in accordance with the teachings of this invention.
Figure 3:
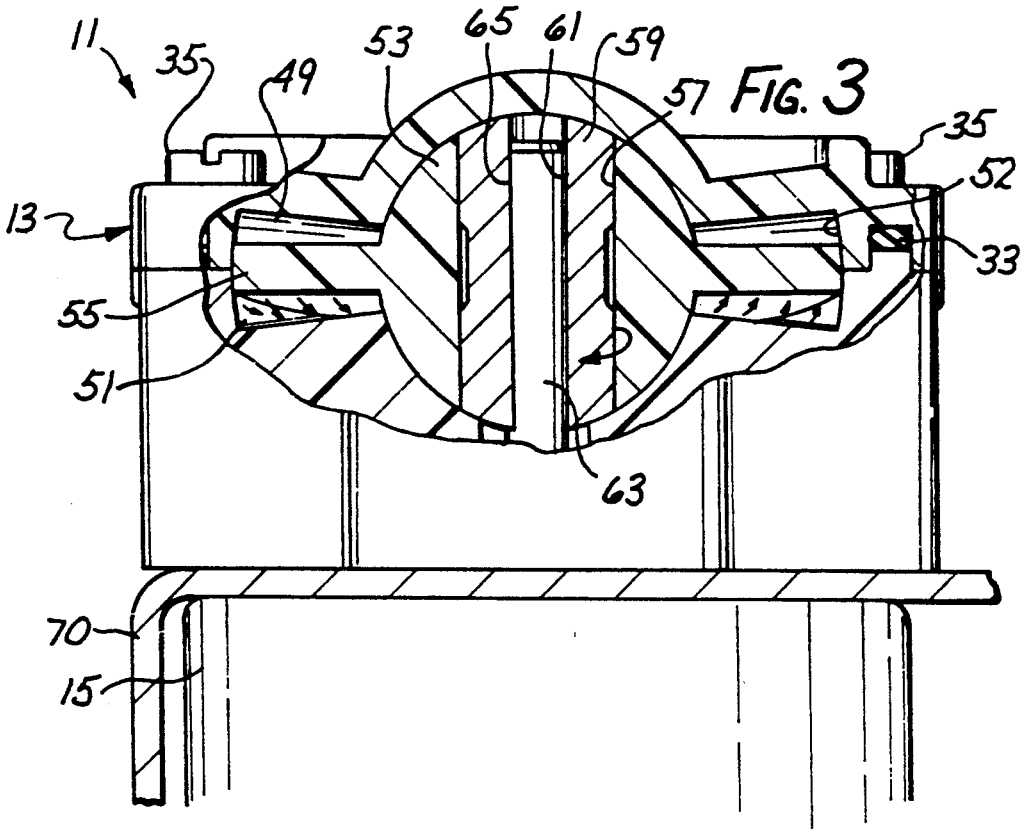
FIG. 3 is a sectional view similar to FIG. 2 and partially in elevation showing the wobble plate in a different angular position.

FIGS. 2 and 3 shown a pump assembly 11 which includes a pump 13 and a motor 15. The motor 15 may be a conventional electric motor of the type commonly used to power small pumps. Although the pump 13 can be used for pumping various liquids, in this embodiment, it is particularly adapted for pumping water or other beverages or beverage components.

The pump includes a pump housing 17 having a cavity 19 therein, an inlet 21 (FIGS. 1 and 4) leading to the cavity and an outlet 23 (FIGS. 1, 4 and 5) leading from the cavity. The pump housing 17 includes housing sections 25 and 27 having confronting faces, with the confronting face of the housing section 25 having an annular groove 29, and the confronting face of the housing section 27 having an annular rib 31 which is received within the groove 29 to axially align the housing sections. The groove 29 and the rib 31 also retain an annular seal 33, which seals between the housing sections 25 and 27. The housing sections 25 and 27 are coupled together in any suitable manner, such as by threaded fasteners 35.

The cavity 19 has opposing wall sections which in this embodiment are conical sections 37 and 39 and opposing part-spherical sections 41 and 43 formed on the inner surfaces of the housing sections 25 and 27. In addition, the housing section 27 has an axial opening 45 leading to the part-spherical section 43.

The housing sections 25 and 27 also have relatively short spherical peripheral wall sections that cooperate to define a part-spherical peripheral wall 52. The part-spherical wall 52 terminates in openings 54 and 56 (FIGS. 1 and 4) which lead to the inlet 21 and the outlet 23.

The pump 13 also includes a wobble plate 47 in the cavity 19 and dividing the cavity into pumping chambers 49 and 51 (FIG. 3). The wobble plate 47 includes a part-spherical central hub 53 received in the part-spherical sections 41 and 43 and a flange 55 between the conical sections 37 and 39. In this embodiment, the flange 55 is flat, planar and annular and just fits within the cavity 19 as shown in FIGS. 2 and 3 with sufficient clearance to allow the wobble plate to wobble.

Means is provided for mounting the wobble plate 47 for nutating movement in the cavity 19 so that liquid entering the inlet 21 into the pumping chambers 49 and 51 is pumped by the wobble plate 47 through the outlet 23. Thus, the wobble plate 47 serves as a positive displacement pumping member that acts directly against the liquid being pumped.

In the form shown in FIGS. 1-5, the mounting means includes the hub 53 having a central passage 57 therein and a bushing or eccentric 59 rotatable in the passage 57. The bushing 59 has a bore 61 extending therethrough, and the longitudinal axes of the passage 57 and the bore 61 are inclined as shown in FIG. 2.

The motor 15 has a rotatable shaft 63 which is received in the bore 61 and drivingly coupled to the bushing 59 in any suitable manner, such as by a flat surface 65 of the shaft and a mating flat surface on the bore 61. The bushing 59 is axially slidable on the shaft 63 and has spherical opposite end surfaces which mate with and are slidable along, the part-spherical sections 41 and 43, respectively. Accordingly, the axial position of the bushing 59 along the shaft 63 is determined by the part-spherical sections 41 and 43.

Figure 1:
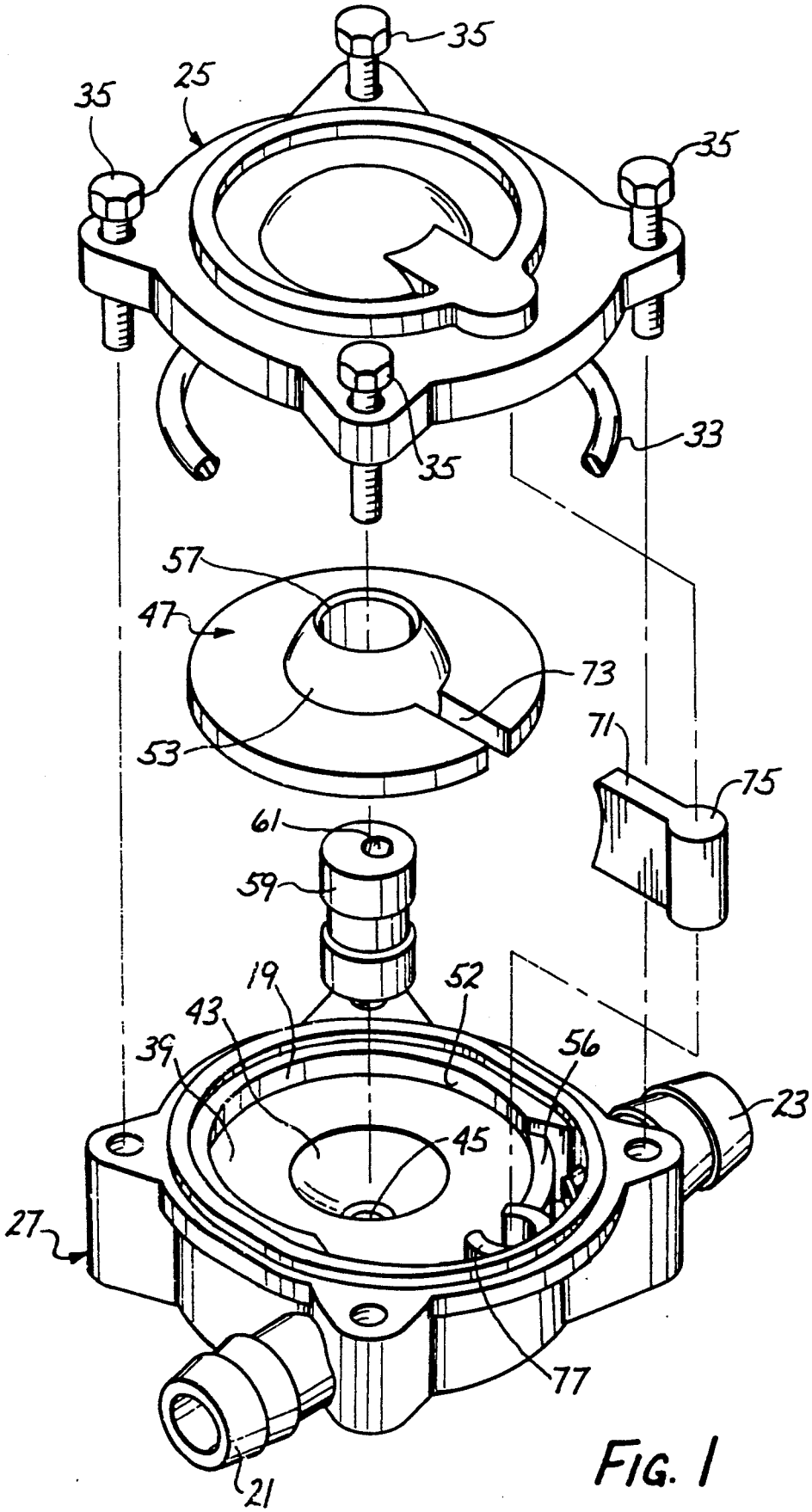
FIG. 1 is an exploded perspective view of a pump constructed in accordance with the teachings of this invention.

An annular, rotary shaft seal 67 seals the surface between the rotatable shaft 63 and the pump housing 17. The pump housing 17 is affixed to the motor 15 and a mounting bracket 70 (FIGS. 2 and 3) in any suitable manner, such as by screws 69 (FIGS. 1-3).

The means for mounting the wobble plate 47 for nutating movement also includes a separator 71 (FIGS. 1 and 4) and a slot 73 in the wobble plate 47 which receives the separator so that the separator holds the wobble plate against rotation. Accordingly, rotation of the shaft 63 causes nutating motion of the wobble plate 47.

The separator 71 also serves to separate the openings 54 and 56 which lead to the inlet 21 and the outlet 23, respectively. Thus, the separator 71 separates the inlet 21 from the outlet 23 so that the only path between the inlet and the outlet is through the pumping chambers 49 and 51.

The separator 71 can be mounted in various different ways, and in this embodiment, it includes an enlarged head 75 slidably received in a cradle 77 (FIGS. 1 and 4) to thereby fixedly mount the separator on the pump housing 17, with the separator extending radially inwardly toward the shaft 63.

The housing sections 25 and 27, the wobble plate 47, and the separator 71 can advantageously be integrally molded from a suitable hard, rigid plastic material. The bushing 59 is preferably constructed of a metal, such as brass or stainless steel, and the shaft 63 is preferably of metal, such as steel.

In operation, rotation of the shaft 63 by the motor 15 causes the wobble plate 47 to nutate. The liquid being pumped, such as water, enters the inlet 21 and passes through the opening 54 (FIG. 4) to the pumping chambers 49 and 51. The nutating motion of the wobble plate 47 in the pumping chambers 49 and 51 causes the water received from the inlet 21 to be moved around the pumping chambers to the opening 56 of the outlet 23. The wobble plate 47 makes line contact with the conical sections 37 and 39 at locations spaced apart 180 degrees, and the line contact moves through the pumping chambers 49 and 51 as the wobble plate nutates to achieve the pumping action. The two pumping chambers 49 and 51 continuously receive water from the inlet 21 and continuously discharge water to the outlet 23. The pumping chambers 49 and 51 operate 180 degrees out-of-phase so that the volume of water discharged by the pumping chambers 49 and 51 varies inversely. The volume discharged by each of the pumping chambers varies continuously form zero to maximum flow and then back to zero. The combined volumes discharged by both of the pumping chambers 49 and 51 is substantially constant. Consequently, there is a continuous, uninterrupted flow of water to the outlet 23 with little or no surging.

Figure 6:
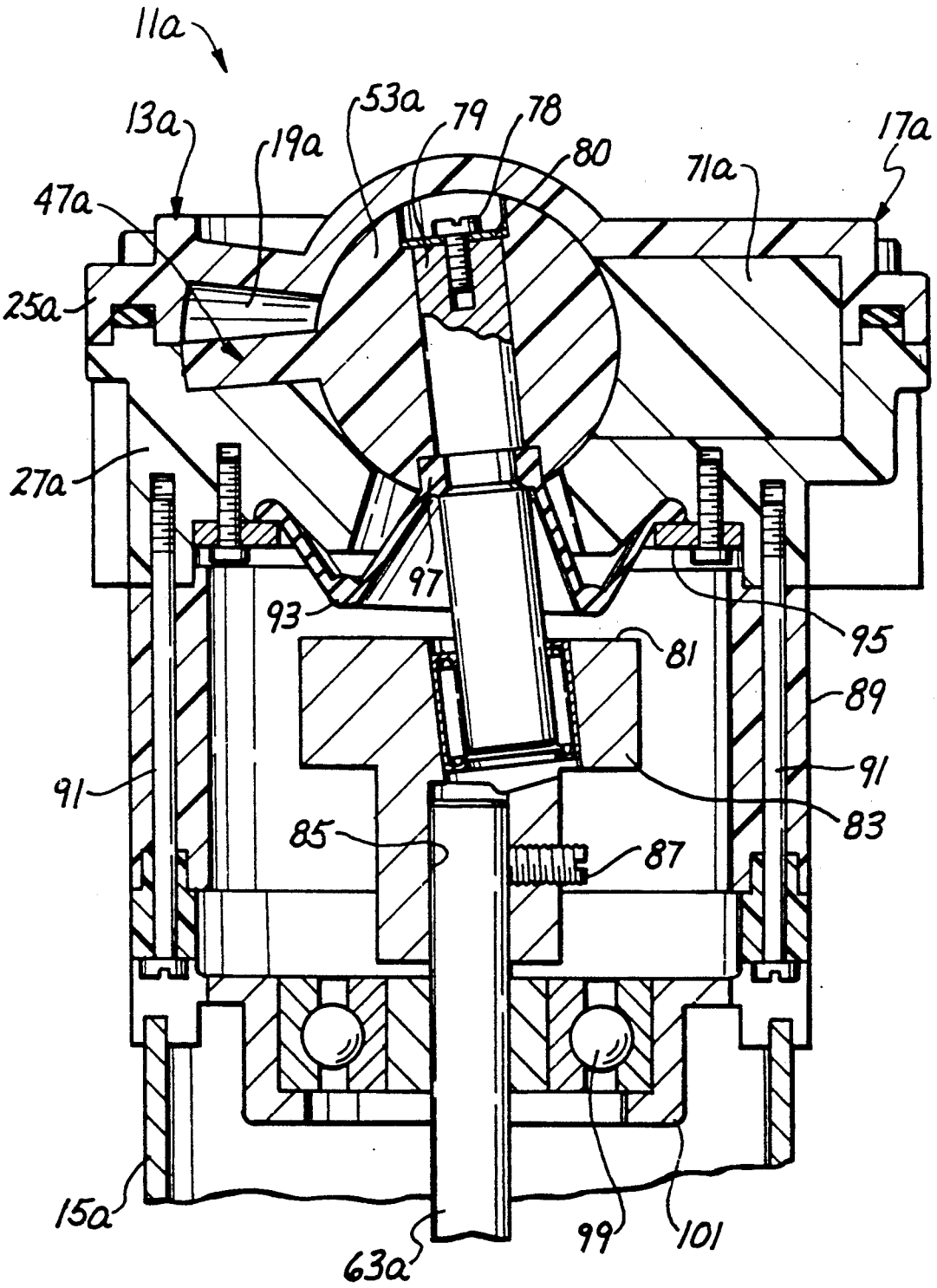
FIG. 6 is an axial sectional view through a different form of pump constructed in accordance with the teachings of this invention.

FIG. 6 shows a pumping assembly 11*a* which is identical to the pumping assembly 11 in all respects not shown or described herein. Portions of the pumping assembly 11*a* corresponding to portions of the pumping assembly 11 are designated by corresponding reference numerals followed by the letter "a". The primary difference between the pumping assemblies 11 and 11*a* is in the manner in which the wobble plate is mounted for nutatinq movement. More specifically, with the pump assembly 11*a* , the bushing 59 is eliminated, and a shaft 79 extends into the passage 57*a* and is suitably coupled to the hub 53*a* of the wobble plate 47*a* as by a screw 78 and washer 80. The shaft 79 extends out of the cavity 19*a* and is received in a bearing 81 eccentrically carried by a rotary drive member 83. The drive member 83 has an axial passage 85 for receiving the shaft 63*a* of the motor (not shown in FIG. 6). The drive member 83 is drivingly coupled to the motor shaft 63*a* in any suitable manner, such as by a set screw 87.

The pump housing 17*a* also includes a tubular housing extension 89, which is joined to the housing section 27*a* by screws 91. The housing extension 89 houses the drive member 83 and receives portions of the shafts 63*a* and 79. The shaft seal 67 of the embodiment of FIGS. 1–5 is eliminated in favor of a flexible bellows-type seal or flexible boot 93 which is held against the housing section 27*a* by a retainer 95 and which has a bead 97 which surrounds and sealingly engages the shaft 79. Because the shaft 79 undergoes a conical motion and does not rotate about its axis, sealing of the shaft is facilitated. The shaft 63*a* is supported for rotation by a ball bearing 99 carried by a bearing retainer 101 mounted on the housing extension 89 and the motor 15*a* in any suitable manner, such as by screws (not shown).

Rotation of the shaft 63*a* by the motor rotates the drive member 83 about its axis, and this drives the shaft 79 along a conical path to cause the wobble plate 47*a* to nutate. The pumping action of the pump 13*a* is identical to the pumping action of the pump 13. However, this embodiment has the advantage of having the bearing 81 out of the cavity 19*a* so that lubricants can be used on the bearing without contaminating the liquid being pumped. In addition, this embodiment enables the use of the bellows seal 93 rather than the rotary shaft seal 67.

FIGS. 7 and 8 show a pumping assembly 11*b* which is identical to the pumping assembly 11 in all respects not shown or described herein. Portions of the pumping assembly 11*b* corresponding to portions of the pumping assembly 11 are designated by corresponding reference numerals followed by the letter "b".

The primary difference between the pumping assemblies 11 and 11*b* is that the latter includes a resilient member 121 for resiliently urging the wobble plate 47*b* toward opposing wall sections which, in this embodiment, are the opposing conical sections 37*b* and 39*b*. More specifically, it is the flange 55*b* of the wobble plate 47*b* which is urged toward and resiliently loaded against the opposing conical sections 37*b* and 39*b*.

As shown in FIGS. 7 and 8, the bushing 59*b* includes an outer sleeve 123 in the central passage 57*b* of the hub 53*b*. The outer sleeve 123 has a sleeve passage 125. The bushing 59*b* also includes the resilient member 121, and the resilient member is received in the sleeve passage 125. The resilient member 121 is also in the form of a sleeve and has the bore 61*b* extending through it for receiving the shaft 63*b*.

The outer sleeve 123 has a cylindrical outer surface 127 (FIG. 8) which is slidably received in the central passage 57*b* and has opposite spherical end faces 129 (FIG. 7) which are slidably engageable with the part-spherical sections 41*b* and 43*b*, respectively. Also, the resilient member 121 is slidable axially on the shaft 63*b*. Consequently, the axial position of the bushing 59*b* along the shaft 63*b* is determined by the part-spherical sections 41*b* and 43*b* as described above in the embodiment of FIGS. 1–5.

The outer sleeve 123 is preferably constructed of a relatively hard material. It is preferred to mold the resilient member 121 into the outer sleeve 123, and consequently the material for the outer sleeve should be able to withstand the heat of molding if this molding technique is to be employed. For example, the outer sleeve 123 may be a metal such brass or sintered bronze or a relatively hard polymer, such as nylon.

The resilient member 121 should have the resilient properties desired for resiliently urging the wobble plate 47*b* toward and against the opposing conical sections 37*b* and 39*b* at locations spaced apart 180°. To accomplish this purpose, the resilient member 121 is preferably an elastomeric material and an ethylene propylene rubber such as the rubber product sold by Monsanto under the trademark Santoprene is most preferred.

In the preferred construction illustrated in FIGS. 7 and 8, the inner surface of the outer sleeve 123 is appropriately contoured to interlock with the resilient member 121 which is molded into it. Although various constructions are possible, in the embodiment shown, the resilient member 121 the sleeve 123 have interlocking axially extending splines 131 and 133 (FIG. 8), respectively, and interlocking annular shoulders 135 (FIG. 7) formed at the juncture of relatively large and relatively small diameter portions of the resilient member and the outer sleeve. The shaft 63*b* is drivingly coupled to the resilient member 121 by virtue of flat surfaces 65*b* (FIG. 8) on the shaft 63*b* and cooperating flat surfaces on the bore 61*b*.

The resilient member 121 resiliently urges and loads the flange 55*b* toward and against at least one of and preferably against both of the wall sections 37*b* and 39*b*. This can be accomplished, for example, by simply sizing of the components such that the desired resilient loading of the flange 55*b* against the wall sections 37*b* and 39*b* occurs. Alternatively, this can be accomplished by appropriately sizing certain angles as described below.

Figure 7A:
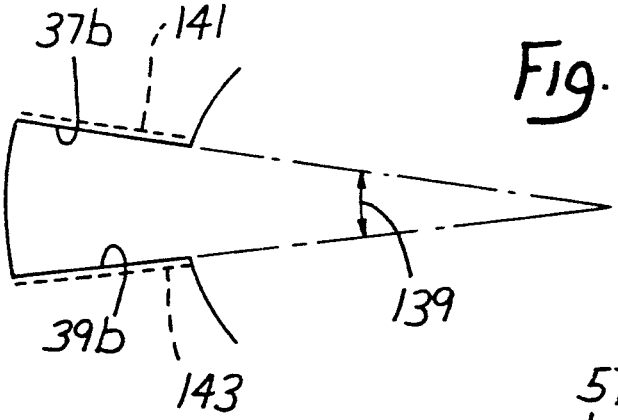
FIG. 7A is a schematic illustration illustrating how the wobble angle can exceed the cone angle.

The nutating movement of the wobble plate 47 has a center 137 about which the nutating movement occurs. The center 137 of nutating movement is at the center of the spherical surface of the hub 53*b* and the part spherical sections 41*b* and 43*b*. Extensions of the conical sections 37*b* and 39*b* as shown in FIG. 7A intersect to form a cone angle 139 which may be, for example, about 14 degrees. The bushing 59*b* and the wobble plate 47*b* are arranged to provided the wobble plate with a wobble angle which is larger than the cone angle 139. For example, the wobble angle may be about two degrees larger than the cone angle and centered on the cone angle such that the flange 55*b* of the wobble plate would, but for the presence of the conical sections 37*b* and 39*b*, move to positions 141 and 143 as shown schematically in FIG. 7A. Alternatively, the components, such as the flange 55b, may be sized so that even if the wobble angle and cone angle 139 are equal, the flange 55b would, but for the presence of the conical sections 37b and 39b, move to the positions 141 and 143. In either case, tight engagement between the flange 55b and the conical sections 37b and 39b along the lines of contact between the surfaces is assured. Employing a wobble angle larger than the cone angle 139 is made possible by the resilient member 121 which can deformed to allow cooperation between the conical wall sections 37b and 39b and the wobble plate 47b to resiliently reduce the wobble angle to about the cone angle 139 such that pumping action with considerable priming capability can occur.

The hard outer sleeve 123 assures that the deformation of the resilient member 121 necessary to resiliently load the flange 55b against the wall sections 37b and 39b can occur at the opposite ends of the resilient member 121. In this regard, the outer sleeve 123, the part-spherical sections 41b and 43b and the other structure of the pump assembly 11b allow for slight bulging of the resilient member 121 as may be required as a result of the radial squeezing load placed on the resilient member.

Another advantage of the resilient member 121 is in modulating the output of the pump assembly 11b if substantial back pressures are encountered. Thus, by selecting the shore hardness of the elastomeric material of the resilient member 121, the pump assembly 11b can be provided with an output which reduces in accordance with the back pressure encountered at the outlet of the pump assembly. Because a high back pressure tends to provide a heavy load on the motor which drives the pump, this back pressure responsive technique can be used to reduce the output of the pump assembly 11a and to reduce this problem.

Figure 10:
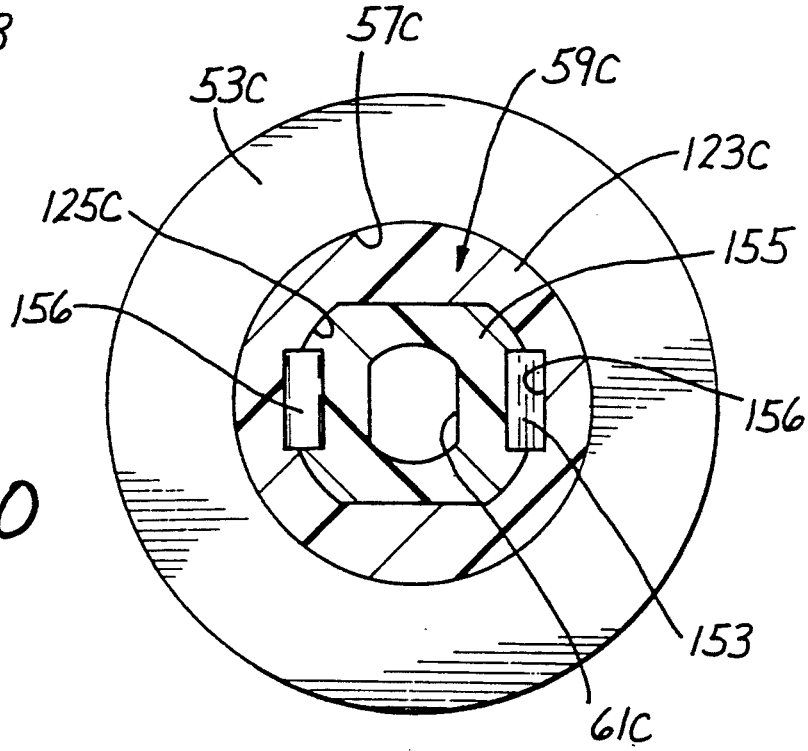
FIG. 10 is a sectional view taken generally along line 10—10 of FIG. 9.
Figure 9:
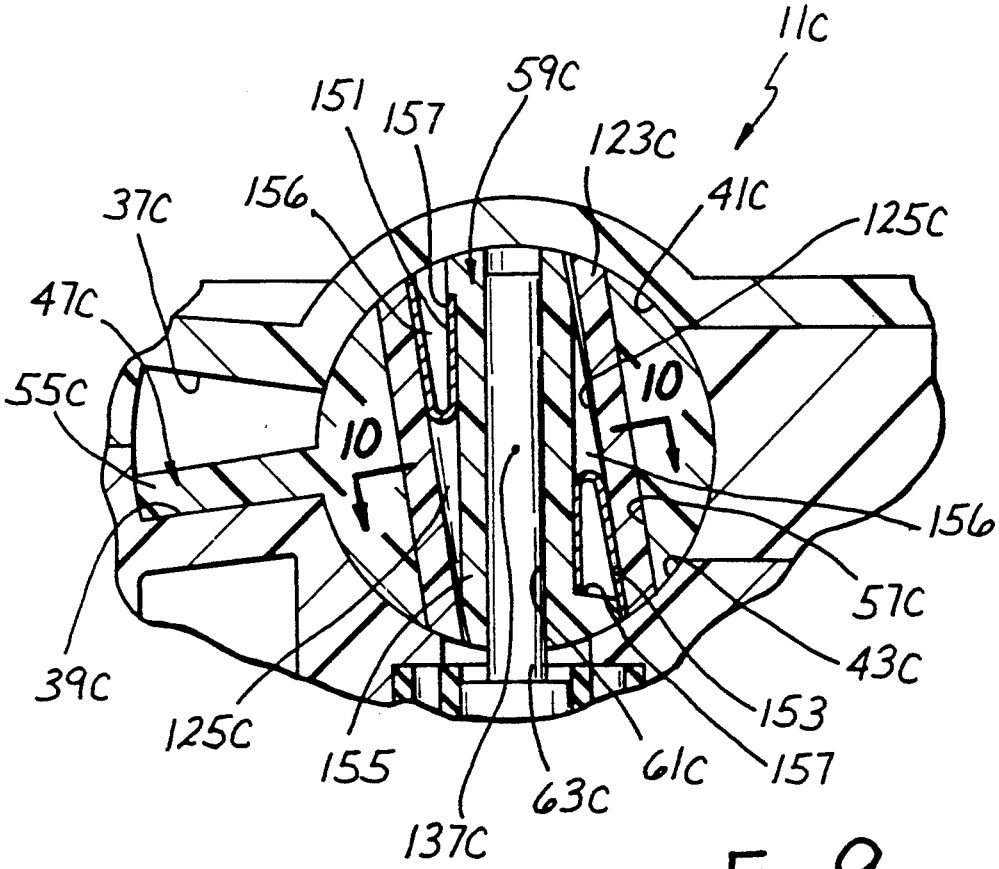
FIG. 9 is a sectional view similar to FIG. 7 showing another way to employ the resilient element.

FIGS. 9 and 10 show a pumping assembly 11c which is identical to the pumping assembly 11b in all respects not shown or described herein. Portions of the pumping assembly 11c corresponding to portions of the pumping assembly 11b are designated by corresponding reference numerals followed by the letter "c".

One difference between the pumping assemblies 11b and 11c is that the resilient member 121 of the pumping assembly 11b is replaced with a resilient member which includes one or more springs. In the form shown two springs 151 and 153 are provided. The springs 151 and 153 can be of various different constructions and materials, but in the embodiment illustrated are in the form of U or V shaped spring clips and are constructed of a metal compatible with the liquid to be pumped. For example, the springs may be of stainless steel.

In the embodiment of FIGS. 9 and 10, the bushing 59c includes the outer sleeve 123c, the springs 151 and 153 and an inner sleeve 155 received in the sleeve passage 125c along with the springs. The inner sleeve 155 has the bore 61c therein and may be constructed of the same hard material as the outer sleeve 123c. The inner sleeve 155 is slidable axially on the shaft 63c and the outer sleeve 123c is slidable axially on the inner sleeve 155 such that the part-spherical sections 41c and 43c control the axial positions of all of these members.

The springs 151 and 153 are between the outer sleeve 123 and the inner sleeve 155 and are retained between these sleeves in any suitable manner. For example, sleeves 123c and 155 may have confronting notches defining tapered pockets 156 in which the springs 151 and 153 are located, respectively. Shoulders 157 on the inner sleeve 155 retain the springs 151 and 153 against movement away from each other as shown in FIG. 9 and the springs 151 and 153 are confined circumferentially in the pockets 156 (FIG. 10).

As shown in FIG. 10, the sleeve passage 125c and the outer surface of the inner sleeve 155 are of non-circular configuration so as to interlock the sleeves for rotation together with the shaft 63c. However, there is sufficient radial clearance between the sleeves 123c and 155 to allow the outer sleeve 155 and the wobble plate 47c to pivot slightly about the center 137c of the nutating motion. Specifically, there is only minimal clearance between the sleeves 123c and 155 along the plane 10—10 of FIG. 9, which passes through the center 137c of nutating movement. However, the sleeves are sized so that at locations axially outwardly of the plane 10—10, there is adequate radial clearance to allow the necessary pivotal or rocking motion of the outer sleeve 123c relative to the inner sleeve 155. Consequently, the springs 151 and 153 can resiliently urge the wobble plate 47c, and in particular the flange 55c against the conical sections 37c and 39c. In this embodiment, the springs 151 and 153 are on opposite sides of the center 137c of the nutating motion and the V-shaped springs open in opposite directions.

The operation of the pumping assembly 11c is the same as that described above for the pumping assembly 11b. Also, by providing the springs 151 and 153 with appropriate resilience, the back pressure responsive feature discussed above for the pump assembly 11b may also be incorporated into the pumping assembly 11c.

FIGS. 11–14 show a pumping assembly 11d which is identical to the pumping assembly 11b in all respects not shown or described herein. Portions of the pumping assembly 11d corresponding to portions of the pumping assembly 11b are designated by corresponding reference numerals followed by the letter "d".

The primary difference between the pumping assembly 11b and the pumping assembly 11d is that the resilient member 121d is part of the wobble plate 47d. Specifically, the resilient member 121d forms a portion of the flange 55d and is resiliently engageable with one and preferably both of the opposing wall sections 37d and 39d. The remainder of the wobble plate 47d may be considered as a carrier which is more rigid than the resilient member and on which the resilient member is mounted.

More specifically, the wobble plate 47d also includes a apertured plate 165 having apertures 167, a hub member 169 and a sleeve 171. The plate 165 extends radially of the hub member 169 and is annular and rigid so it can rigidly support the resilient member 121d. In this regard, the plate 165 is preferably constructed of a metal such as stainless steel or brass. The sleeve 171 is also rigid and preferably constructed of a metal which may be, for example, stainless steel or brass. The sleeve 171 has the central passage 57d extending through it.

The hub member 169 is preferably molded of a suitable hard polymeric material such as a phenolic, epoxy or polyetherether ketone. In a preferred method, the plate 165 and the sleeve 171 are placed into a mold and the polymeric material of the hub member 169 is poured into the mold to thereby capture the plate and sleeve in hub member 169. In this regard, the inner periphery of the plate 165 is received in an annular outwardly opening groove 173 of the hub member 169 and the sleeve 171 is captured by annular shoulders 175 of the hub member 169 at the opposite ends of the sleeve.

The resilient member 121d can advantageously be molded over the plate 165 so as to cover the opposite sides of the plate as well as the outer periphery of the plate as shown in FIGS. 11 and 12. In addition, the resilient member 121d in this embodiment covers a small portion of the surface of the hub member 169. Thus, the hub member 169 and a small portion of the resilient member 121d define the part spherical surfaces which slidably cooperate with the part spherical sections 41d and 43d, respectively. However, it is the spherical portions of the hub member 169 which are load bearing.

The wobble plate 47d is preferably resiliently loaded against the wall sections 37d and 39d by virtue of the thickness of the resilient member 121d rather than by any difference between the cone angle and the wobble angle as discussed above in connection with the pump 11b of FIGS. 7 and 8. Various elastomeric and polymeric materials can be used for the resilient member 121d. For example, polyethylene or an ethylene propylene rubber such the rubber product sold by Monsanto under the trademark Santoprene can be used. Because the nutating motion does not involve sliding contact between the resilient member 121d and the wall sections 37 and 39d, the wear resistance of the resilient member 121d is not as important as if sliding contact were involved.

Figure 13:
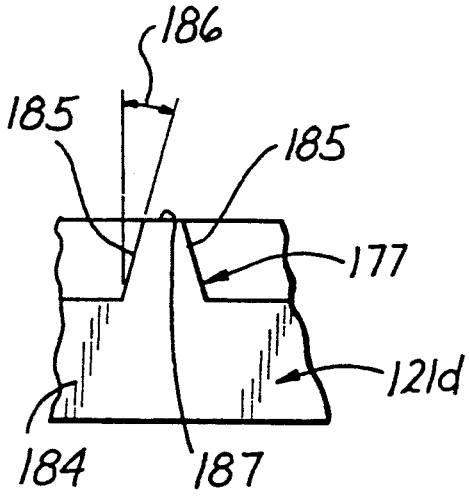
FIG. 13 is an enlarged, fragmentary elevational view illustrating a portion of the wobble plate and one of the radially extending ribs.
Figure 14:
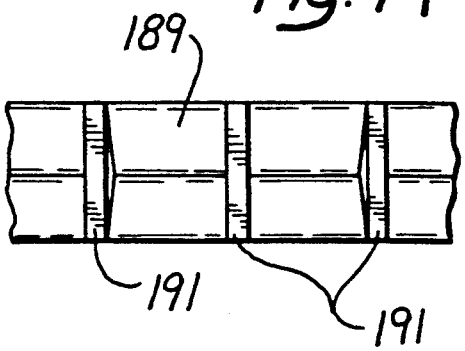
FIG. 14 is an enlarged, fragmentary elevational view of a portion of the edge of the wobble plate of FIG. 12.

The resilient member 121d has a plurality of generally radially extending ribs 177, an outer annular rib 179, an inner annular rib 181, intermediate annular ribs 183 (FIG. 12) and a base 184 (FIG. 13). In this embodiment, the ribs 177 extend radially and adjacent ribs are equally spaced circumferentially. The circumferential spacing between the ribs 177 is such that there are at least two of the ribs 177 engaging each of the wall sections 37d and 39d throughout the nutating movement of the wobble plate 47d. Of course, other arrangements are possible.

Preferably each of the ribs 177 is of progressively deceasing cross sectional area as the rib extends outwardly, i.e. away from the base 184 (FIG. 13) or axially outwardly in the embodiment illustrated. For example, each of the ribs 177 may have sides 185 (FIG. 13) which slope toward each other as the ribs extend away from the base 184 of the resilient member 121d. For example, each of the sides 185 may slope inwardly at an angle 186 of about 15 degrees and terminate in a flat, planar end surface 187 which is about 0.010 inch in width. The height of each of the ribs 177, i.e. the distance between the end surface 187 and the base 184 may be, for example, about 0.020 inch and each of the ribs 177 at its base may be about 0.020 inch in width. Of course, these dimensions are purely illustrative. Regardless of the specific configuration or size of the ribs 177, the end surfaces 187 contact the wall sections 37d and 39d and this provides increased unit loading against the ribs in order to get the desired resilient deformation of the resilient member 121d. All of the ribs 177, 179, 181 and 183 may be sized and shaped as described above in connection with FIG. 13.

The outer annular rib 179 and the inner annular rib 181 prevent radial outward and radial inward leakage, respectively, of the liquid being pumped as the wobble plate 47d nutates. The annular ribs 179 and 181, together with the annular ribs 183 form an annular region which engages the opposing wall sections 37d and 39d throughout the nutating movement of the wobble plate 47d to reduce the noise that may be induced if only the radial ribs 177 were utilized. In this latter event, the movement of the radial ribs 177 into and out of contact with the wall sections 37d and 39d at a high rate of speed may create noise which the continuous contact provided by the annular ribs reduces or eliminates.

Although various patterns are possible in this embodiment, the ribs 177 intersect the ribs 179, 181 and 183 to define a plurality of pockets 188 (FIG. 12) which create a waffle-like pattern on the face of the resilient member 121d. Any desired number of the annular ribs 179, 181 and 183 may be provided and the number shown is purely illustrative. Similarly, the radial spacing between adjacent annular ribs is only illustrative. The configuration of the resilient member 121d may be the same on both faces, and the heights of all of the ribs are preferably equal.

The resilient member 121d defines the outer peripheral surface of the wobble plate 47d as well as an outwardly opening annular groove 189 (FIGS. 11 and 14) which circumscribes the wobble plate 47d. The groove 189, which may be of generally V-shaped cross section, has a plurality of dams 191 extending axially across it for the full height of the groove. The groove 189 provides greater flexibility of the outer peripheral region of the resilient member 121d for engagement with the peripheral wall 52d of the pump cavity 19d. The dams 191 prevent loss of fluid being pumped as a result of the fluid running circumferentially along the groove 189.

The wobble plate 47d is mounted for nutating movement by the bushing 57d and motor shaft 63d in the same manner described above for the pump 11 of FIGS. 1–5. However, when mounted for nutating movement, the wobble plate 47d is resiliently loaded against the opposing wall sections 37d and 39d by the resilient member 121d so as to deform the radial ribs 177 and the portions of the annular ribs 179, 181 and 183 which engage the opposing wall sections. In this embodiment, as well as the embodiments of FIGS. 7–9, expansion of the resilient member 121d is resisted by the wall sections 37d and 39d such that the resilient member provides the resilient driving force for resiliently urging the wobble plate toward and against the wall sections. The nutating motion of the wobble plate 47d provides pumping action in two pumping chambers as described above in connection with FIGS. 1–5; however, the resilient engagement of the resilient member 121d with the wall sections 37d and 39d provides an increased priming capability. At least two of the radial ribs 177 on each face of the wobble plate 47d are preferably in contact with the opposing wall sections 37d and 39d throughout the full nutating movement of the wobble plate 47d.

Figure 15:
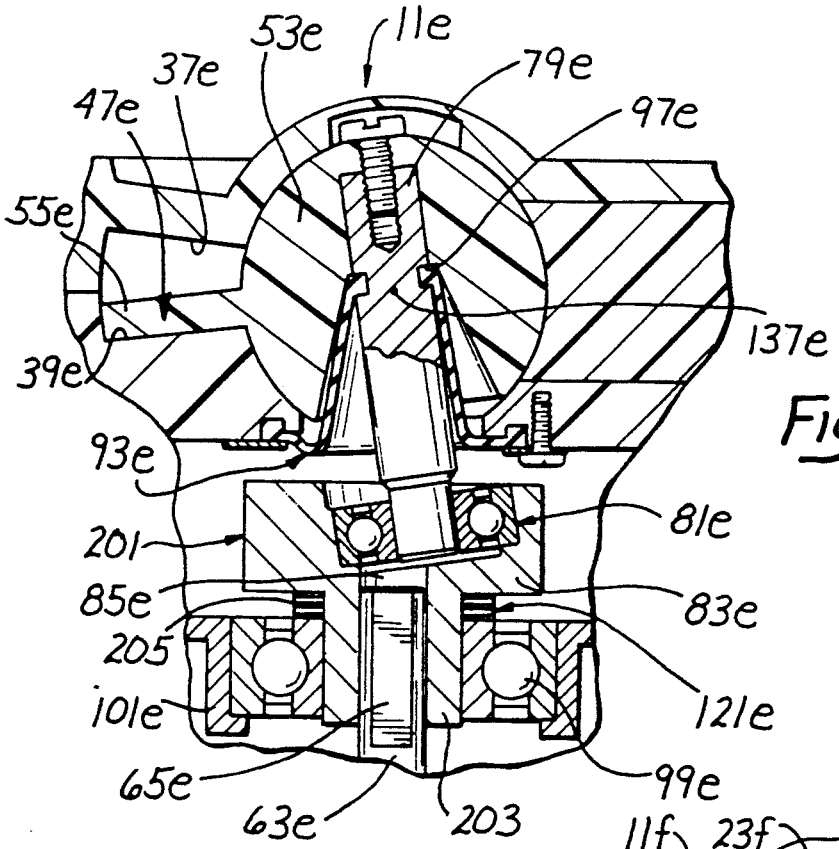
FIG. 15 is a sectional view similar to FIG. 6 showing the attachment of the flexible boot to the shaft in a way to minimize flexure of the boot and an alternate way to utilize the resilient member.

FIG 15 shows a pump assembly 11e which is identical to the pump assembly 11a in all respects not shown or described herein. Portions of the pump assembly 11e corresponding to portions of the pump assembly 11a are designated by corresponding reference numerals followed by the letter "e".

There are two primary differences between the pump assemblies 11e and 11a. First, the flexible boot 93e is coupled and sealed to the shaft 79e substantially at a radial zone of the shaft which includes the center 137e of the nutating movement. In this regard, the bead 97e is held between a groove in the shaft 79e and the hub 53e. By locating the bead 97 substantially at a radially zone of the shaft 79e which includes the center 137e, the flexure and movement of the flexible boot 93e is minimized as the wobble plate 47e nutates. Consequently, less energy is required to drive the wobble plate 47e and wear on the flexible boot 93e is reduced.

The second primary difference is the addition of the resilient member 121e which is part of the mounting assembly which mounts the wobble plate 47e for nutating movement. The resilient member 121e resiliently urges the wobble plate 47e toward the opposing wall sections 37e and 39e and resiliently loads the wobble plate against the opposing wall sections. More specifically, the bearing 81e and rotary drive member 83e form a bearing assembly 201 which movably receives the shaft 79e and is responsive to a rotary input to move the shaft through a conical arc to impart nutating movement to the wobble plate 47e. The bearing 81e is a ball bearing and slidably receives one end of the shaft 79e. The drive member 83e includes a hollow shaft 203 which is slidably received within an inner race of the ball bearing 99e. The shaft 63e is received within the axial passage 85e and is coupled to the shaft for rotary motion by virtue of the flat surface 65e formed on the shaft and a corresponding flat surface (not shown) on the axial passage 85e.

Although the resilient member 121e may take different forms, in this embodiment, it includes a plurality of metal spring washers 205 interposed between the bearing 99e and the drive member 83. The spring washers 205 resiliently urge the drive member 83e and the ball bearing 81e upwardly as shown in FIG. 15. This movement of the bearing 81e does not urge the shaft 79e upwardly because of the sliding fit between the shaft and the bearing 81e. However, because the end of the shaft 97e that is received in the bearing 81e is radially offset from the center 137, this movement of the bearing 81e tends to resiliently urge the wobble plate 47e counterclockwise (as viewed in FIG. 15) about the center of the part spherical sections 41e and 43e which is also the center 137e of nutating movement. Accordingly, the resilient member 121e resiliently urges the wobble plate to pivot about the center 137e of the nutating movement to urge the flange 55e against the opposing wall sections 37e and 39e at locations spaced apart 180 degrees. As with the other embodiments, the spring rate of the resilient member can be selected depending upon the results desired.

With the washers 205 in the relaxed condition and the drive member 83 resting on the uppermost (as viewed in FIG. 15) washer, the wobble angle may be greater than the cone angle as described above in connection with the pumping assembly 11b (FIGS. 7 and 7A). With this arrangement, the resilient member 121e allows the cooperation between the conical wall sections 37e and 39e and the wobble plate 47e to resiliently reduce the wobble angle to about the cone angle. However, the resilient member 12le is not responsive to increased back pressure to reduce the output of the pump.

Figure 18:
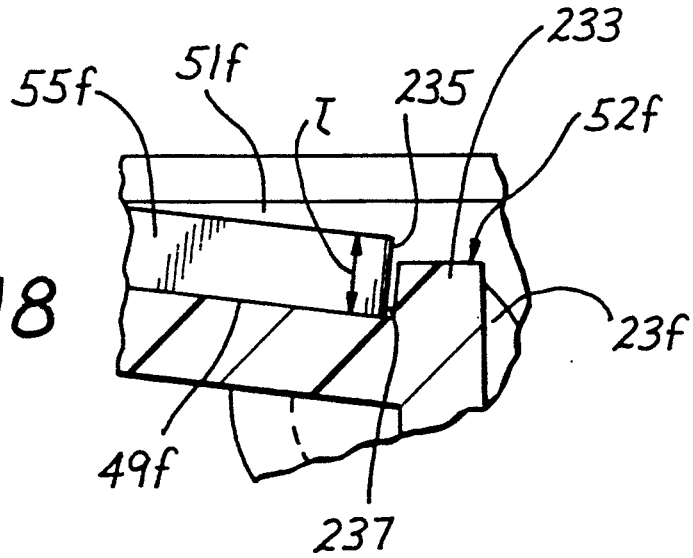
FIG. 18 is an enlarged fragmentary sectional view taken generally along line 18—18 of FIG. 17.
Figure 16:
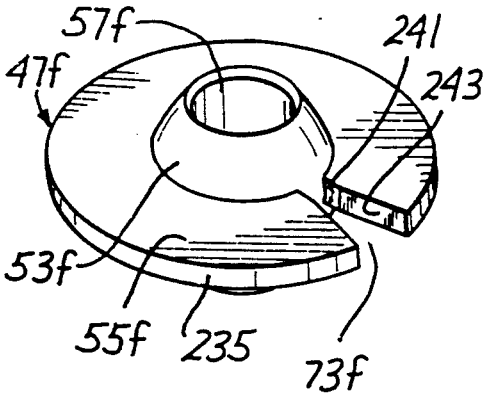
FIG. 16 is a perspective view illustrating an alternate form of wobble plate.
Figure 17:
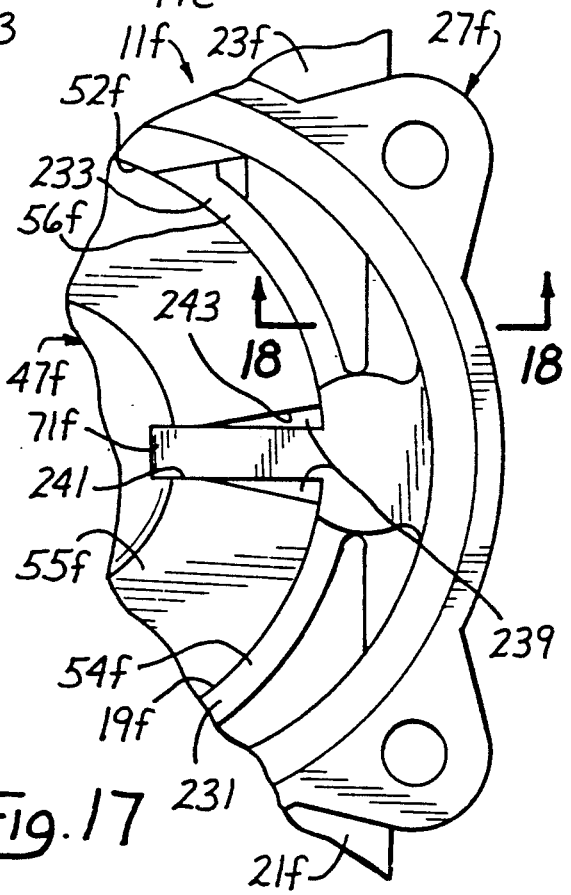
FIG. 17 is an enlarged fragmentary view similar to FIG. 4 showing the alternate wobble plate and a different form of separator.

FIG. 16–18 illustrate a feature of the invention which is useful to increase the priming capabilities of a pump having a wobble plate as the pumping member. The feature of FIGS. 16–18 is useable with any of the embodiments shown and described in connection with FIGS. 1–15.

FIGS. 16–18 shows a pump assembly 11f which is identical to the pump assembly 11 of FIGS. 1–5 in all respects not shown of described herein. Portions of the pump assembly 11f of FIGS. 16–18 corresponding to portions of the pump assembly 11 of FIGS. 1–5 are designated by corresponding reference numerals followed by the letter "f".

The primary differences between the pump assemblies 11f and 11 is that the former utilizes structure near the periphery of the wobble plate 47f and adjacent the inlet 21f and the outlet 23f for increasing the priming capability of the pump. As best seen in FIG. 1, the pump housing has a part spherical peripheral wall 52, and a portion of this wall (designated by the reference character 52f) is shown in FIG. 16. The peripheral wall 52f has an inlet section 231 and an outlet section 233 providing the inlet opening 54f and the outlet opening 56f, respectively. The inlet opening 54f and the outlet opening 56f communicate with the inlet 21f and the outlet 23f, respectively.

The flange 55f of the wobble plate 47f has a peripheral surface 235 (FIGS. 16 and 18) which confront the peripheral wall 52f of the pump cavity 19f as shown in FIGS. 17 and 18. As shown in FIG. 18, the peripheral surface 235 of the wobble plate 47f confronts the peripheral wall 52f and in particular the outlet section 233 and defines therewith a radially narrow gap 237. The width of the gap 237, i.e. the space between the peripheral surface 235 and the outlet section 233 is preferably as small as tolerances reasonably allow and may be, for example, less than about 0.005 inch. In the special case of the pump assembly 11d (FIG. 11–14) where the flange of wobble plate is resilient, the width of this gap may be reduced to zero or near zero. However, this feature of FIGS. 16–18 is usable with the pump assembly 11d because there may be no seal at the wobble plate periphery due to wear or the reduced dimensions of the inlet and outlet sections 231 and 233. The length of the gap 237, i.e. the vertical dimension of the gap as shown in FIG. 18, is greatly increased as compared to the corresponding gap of FIG. 5 to increase the resistance to fluid flow through it. Thus, the peripheral surface 235 has a width t, and the outlet section 233 has a dimension at the gap 237 which is equal to or greater than one half t and which is no greater than about t. Preferably this relationship and structure shown in FIG. 18 also exists at the inlet section 233.

A pump utilizing this feature of FIGS. 16–18 would operate in the same manner as described above for the embodiment with which this feature is used. However, with the gap 237 lengthened, it provides greater resistance for the liquid being pumped to escape or bypass the pumping action and flow back to the inlet 21f. The longer gap 237 functions similarly at the outlet section 233 in that it provides greater resistance to liquid escaping the pumping action and to flowing back toward the inlet where pressures are lower.

Because of the increased resistance to the flow of fluid afforded by the longer gap 237, there is a possibility that liquid could be trapped at the separator 71f and this could cause the pump to stall or impose an additional load on the motor driving the pump. To deal with this, the wobble plate 47f has a flow channel 239 (FIG. 17) adjacent the separator 71f and on the same side of the separator as the relatively long gap 237. In this embodiment, with the relatively long gaps 237 on both sides of the separator, there is a flow channel 239 on both sides of the separator 71f. Preferably, the wobble plate 47f, and in particular the flange 55f is spaced from the separator 71f to define the flow channels 239. In the illustrated embodiment, the slot 73f has an inner region 241 which slidably engages the separator 71f to guide the wobble plate 47f and an outer region 243 spaced from the separator 71f to define the flow channels 239. As shown in FIGS. 16 and 17, the outer portion 243 of the slot 73*f* is formed by walls which diverge as they extend radially outwardly.

Any liquid being pumped which would otherwise be trapped or tend to form a hydraulic lock at the separator 71*f* on the outlet side of the separator 71*f* passes through the flow channel 239 on the outlet side of the separator. Similarly, liquid can pass through the flow channel 239 on the inlet side of the separator 71*f* to prevent the pumping chambers 49*f* and 51*f* (FIG. 18) from being starved for liquid due to the increased resistance to the flow of liquid caused by the longer gap 237 on the inlet side of the separator.

Another optional feature of FIGS. 16–18 is that the separator 71*f* is integral with the housing section 27*f*.

Although exemplary embodiments of the invention have been shown and described, many changes, modifications and substitutions may be made by one having ordinary skill in the art without necessarily departing from the spirit and scope of this invention.

We claim:

1. A pump comprising:

a housing having a cavity therein, an inlet leading to said cavity and an outlet leading from said cavity;

a wobble plate in said cavity dividing said cavity into first and second pumping chambers, said wobble plate having a passage;

said cavity having opposing wall sections configured to allow nutating movement of the wobble plate;

a mounting assembly for mounting the wobble plate for said nutating movement in said cavity whereby liquid entering the inlet into the pumping chambers can be pumped by the wobble plate through the outlet as a result of the nutating movement and cooperation between the wobble plate and the opposing wall sections; and the mounting assembly including a resilient member in the passage of the wobble plate for resiliently loading the wobble plate against at least one of the opposing wall sections.

2. A pump as defined in claim 1 wherein the resilient member resiliently loads the wobble plate against both of the opposing wall sections.

3. A pump as defined in claim 1 wherein the opposing wall sections are conical and diverge radially outwardly at a cone angle to allow nutating movement of the wobble plate, the wobble plate is mounted for nutating movement in said cavity through a wobble angle which is larger than the cone angle, and the resilient member allows the cooperation between the conical wall sections and the wobble plate to resiliently reduce the wobble angle to about said cone angle.

4. A pump as defined in claim 1 wherein the opposing wall sections are conical and diverge radially outwardly at a cone angle to allow nutating movement of the wobble plate, the wobble plate is mounted for nutating movement in said cavity through a wobble angle which is of about the same magnitude as the cone angle.

5. A pump as defined in claim 1 wherein the cavity has a peripheral wall configured to allow nutating movement of the wobble plate, said peripheral wall having inlet and outlet sections providing an inlet opening and an outlet opening, respectively, the inlet opening and the outlet opening communicating with the inlet and the outlet, respectively, said wobble plate including a flange with a peripheral surface which confronts the peripheral wall of the cavity and defines therewith radially narrow inlet and outlet gaps at the inlet and outlet sections, respectively, said peripheral surface having a width t at the gaps, and at least one of the inlet and outlet sections of the peripheral wall having a dimension at the associated gap which is equal to or greater than one half t and which is no greater than about t.

6. A pump comprising:

a housing having a cavity therein, an inlet leading to said cavity and an outlet leading from said cavity;

a wobble plate in said cavity dividing said cavity into first and second pumping chambers, said wobble plate having a central passage;

said cavity having opposing wall sections configured to allow nutating movement of the wobble plate, the wobble plate being mounted for nutating movement in said cavity whereby liquid entering the inlet into the pumping chambers can be pumped by the wobble plate through the outlet as a result of the nutating movement and cooperation between the wobble plate and opposing wall sections; and a resilient member in said central passage of the wobble plate for resiliently urging the wobble plate toward the opposing wall sections.

7. A pump as defined in claim 8 wherein the wobble plate includes a central hub having said central passage therein, a bushing in the central passage and having a bore therein, the axes of the central passage and the bore being inclined with respect to each other whereby rotation of the bushing imparts said nutating movement to the wobble plate, and said bushing includes the resilient member.

8. A pump as defined in claim 7 wherein the resilient member is elastomeric.

9. A pump as defined in claim 8 wherein the bushing includes an outer sleeve in the central passage of the hub, said outer sleeve having a sleeve passage, said resilient member being received in the sleeve passage and having said bore therein.

10. A pump as defined in claim 6 wherein the resilient member includes a metal spring.

11. A pump as defined in claim 8 wherein the bushing includes an outer sleeve in the central passage of the hub and an inner sleeve received int he sleeve passage and having said bore therein, said outer sleeve being pivotable relative to the inner sleeve and said resilient member is between the outer and inner sleeves and urges the outer sleeve to pivot relative to the inner sleeve.

12. A pump as defined in claim 11 wherein the resilient member includes first and second metal springs between the outer and inner sleeves.

13. A pump as defined in claim 6 wherein the opposing wall sections include opposing conical sections and opposing part-spherical sections, said wobble plate has a part-spherical central hub having said central passage therein received in said part-spherical sections and a flange between said conical sections, and said resilient member urges the flange against the opposing conical sections.

14. A pump as defined in claim 13 wherein the nutating movement has a center and the resilient member urges the wobble plate to pivot about the center of the nutating movement to urge the flange against the opposing conical sections.

15. A pump as defined in claim 6 wherein the cavity has a peripheral wall configured to allow nutating movement of the wobble plate, said peripheral wall having inlet and outlet sections providing an inlet opening and an outlet opening, respectively, the inlet opening and the outlet opening communicating with the inlet and the outlet, respectively, said wobble plate including a flange with a peripheral surface which confronts the peripheral wall of the cavity and defines therewith radially narrow inlet and outlet gaps at the inlet and outlet sections, respectively, said peripheral surface having a width t at the gaps, and at least one of the inlet and outlet sections of the peripheral wall having a dimension at the associated gap which is equal to or greater than one half t and which is no greater than about t.

16. A pump comprising:

a housing have a cavity therein, an inlet leading to said cavity and an outlet leading from said cavity;

a wobble plate in said cavity dividing said cavity into first and second pumping chambers;

the wobble plate having a central passage, a bushing in the central passage and having a bore therein, the axes of the central passage and the bore being inclined with respect to each other whereby a rotary input applied to the bushing along the axis of the bore imparts a nutating movement to the wobble plate so that liquid entering the inlet into the pumping chambers is pumped by the wobble plate through the outlet; and said bushing including a resilient member.

17. A pump as defined in claim 16 wherein said cavity has opposing conical sections and opposing part-spherical sections, said wobble plate has a part-spherical central hub received in said part-spherical sections and a flange between said conical sections.

18. A pump as defined in claim 16 wherein the bushing includes an outer sleeve in the central passage of the hub, said outer sleeve having a sleeve passage, said resilient member being received in the sleeve passage and having said bore therein.

19. A pump as defined in claim 18 wherein the resilient member is elastomeric.

20. A pump as defined in clam 16 wherein the bushing includes an outer sleeve in the central passage of the hub, an inner sleeve received in the sleeve passage and having said bore therein, said outer sleeve is pivotable relative to the, inner sleeve and said resilient member is between the outer and inner sleeves and urges the outer sleeve to pivot relative to the inner sleeve.

21. A pump comprising:

a housing having a cavity with opposing part-spherical sections, said housing having an inlet leading to said cavity and an outlet leading from said cavity;

a wobble plate in said cavity and dividing said cavity into first and second pumping chambers, the wobble plate including a central part-spherical hub and a flange circumscribing the hub, said central hub being between said opposing part-spherical sections of said cavity;

means for mounting the wobble plate for nutating movement in said cavity whereby liquid entering the inlet into the pumping chambers is pumped by the wobble plate through the outlet;

motor means including a rotatable shaft for driving the wobble plate in said nutating movement;

said mounting means including a central passage in the central hub of the wobble plate, a bushing in the central passage and having a bore therein which drivingly receives the rotatable shaft of the motor means, said bushing being separate from the motor shaft and having opposite ends which confront and are between the opposing part-spherical sections of said cavity, the axes of the central passage and bore being inclined relative to each other whereby a rotary input applied to the bushing along the axes of the bore by the rotatable shaft of the motor means imparts said nutating movement to the wobble plate;

said cavity having opposing wall sections cooperable with the wobble plate to pump the liquid; and means for resiliently urging the flange toward the opposing wall sections.

* * * * *

UNITED STATES PATENT AND TRADEMARK OFFICE

CERTIFICATE OF CORRECTION

PATENT NO. : 5,242,281

DATED : September 7, 1993

INVENTOR(S) : Hartley et al

It is certified that error appears in the above-identified patent and that said Letters Patent is hereby corrected as shown below:

Column 18, line 40 change "8" to -- 7 --.

Column 18, line 42 change "int he" to -- in the --.

Signed and Sealed this

Second Day of August, 1994

*Attest:*

*Attesting Officer*

BRUCE LEHMAN

*Commissioner of Patents and Trademarks*